US009796454B1

(12) United States Patent
Phillips, Jr.

(10) Patent No.: US 9,796,454 B1
(45) Date of Patent: Oct. 24, 2017

(54) SHALLOW WATER ANCHOR SYSTEM

(71) Applicant: John Allen Phillips, Jr., Tampa, FL (US)

(72) Inventor: John Allen Phillips, Jr., Tampa, FL (US)

( * ) Notice: Subject to any disclaimer, the term of this patent is extended or adjusted under 35 U.S.C. 154(b) by 0 days.

(21) Appl. No.: 14/747,147

(22) Filed: Jun. 23, 2015

Related U.S. Application Data

(63) Continuation-in-part of application No. 13/974,459, filed on Aug. 23, 2013, now abandoned.

(60) Provisional application No. 61/743,032, filed on Aug. 24, 2012.

(51) Int. Cl.

| | |
|---|---|
| ***B63B 21/00*** | (2006.01) |
| ***B63B 35/71*** | (2006.01) |
| ***B63B 21/30*** | (2006.01) |
| ***B63B 21/22*** | (2006.01) |

(52) U.S. Cl.
CPC ..... *B63B 21/30* (2013.01); *B63B 21/22* (2013.01); *B63B 35/71* (2013.01); *B63B 2035/715* (2013.01)

(58) Field of Classification Search
CPC ..... B63B 21/24; B63B 21/30; B63B 35/71; B63B 21/22; B63B 2035/715
USPC ..... 114/230.1, 230.16, 230.13, 230.28, 294
See application file for complete search history.

(56) References Cited

U.S. PATENT DOCUMENTS

| | | | | |
|---|---|---|---|---|
| 3,693,569 | A * | 9/1972 | Chauvin | B63B 43/00 114/230.1 |
| 6,220,197 | B1 * | 4/2001 | Pohlman | B63B 21/26 114/294 |
| 6,273,016 | B1 * | 8/2001 | Gibbs | B63B 21/00 114/230.1 |
| 7,921,794 | B1 * | 4/2011 | Cullom | B63B 21/22 114/294 |
| 8,051,789 | B1 * | 11/2011 | Tylisz | B63B 21/22 114/221 R |
| 2006/0207489 | A1 * | 9/2006 | Waldrop | B63B 21/26 114/294 |
| 2007/0181051 | A1 * | 8/2007 | Waldrop | B63B 21/26 114/294 |
| 2009/0223428 | A1 * | 9/2009 | Kivi | B63B 21/00 114/230.1 |

* cited by examiner

*Primary Examiner* — Anthony Wiest

(57) ABSTRACT

A cylindrical receiver has an upper region with female screw threads, a lower region, and a centrally located washer. A cylindrical sleeve has an upper end with male screw threads threadedly coupled to the female screw threads of the receiver. A cylindrical passageway is formed between the receiver and the sleeve. A cylindrical stake is slidably received in the sleeve. A tether line couples the stake to a movable patch whereby when the movable patch is coupled to a fixed patch, the stake will be in a raised orientation and whereby when a user separates the movable patch from the fixed patch, the weight of the stake will lower the stake into a lower orientation into a sandy or rocky bottom.

1 Claim, 7 Drawing Sheets

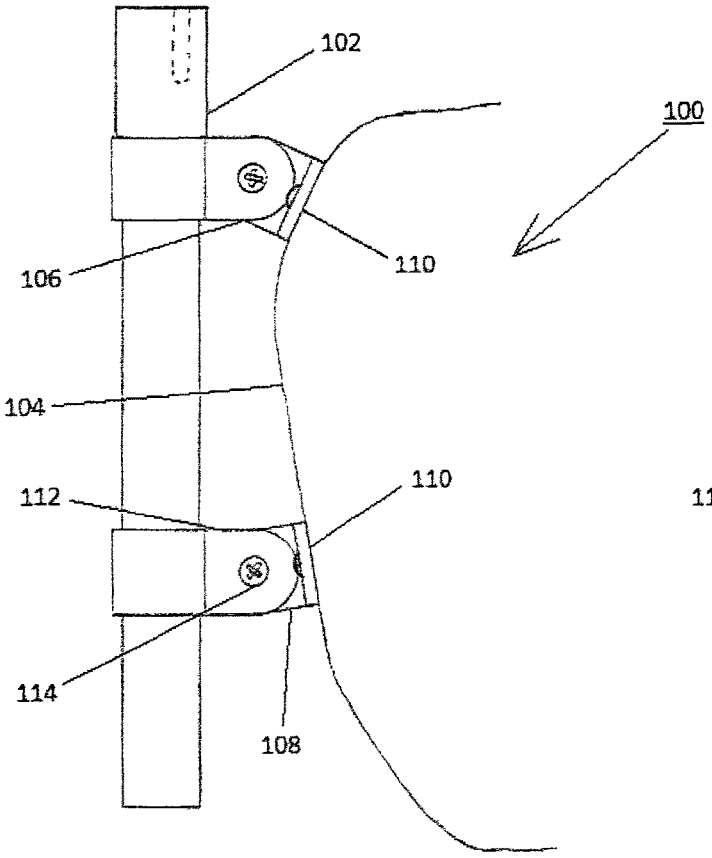
Fig. 5
Fig. 5A
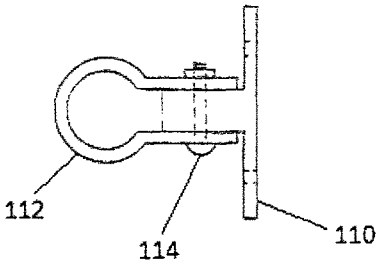

Fig. 6
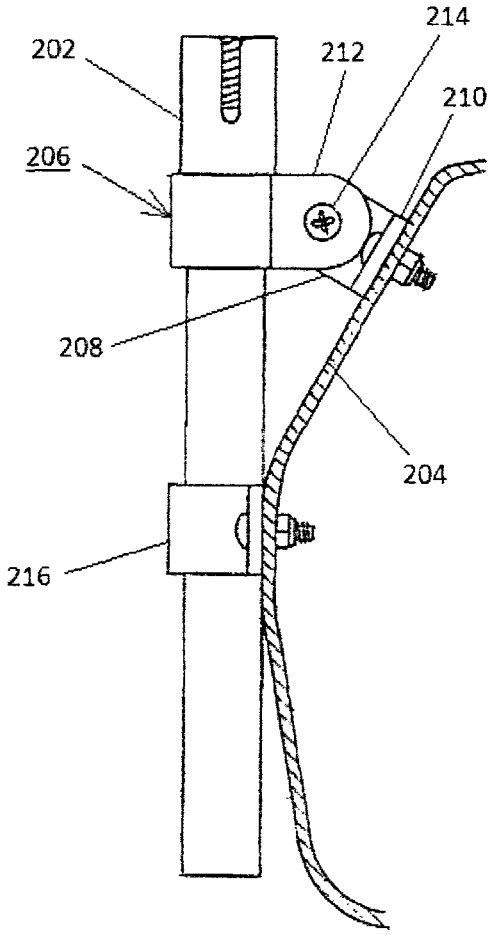
Fig. 6A
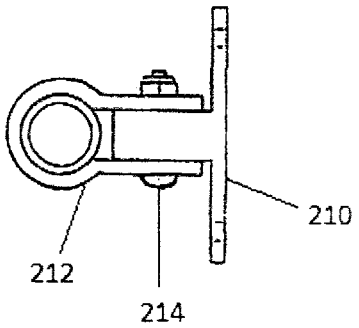
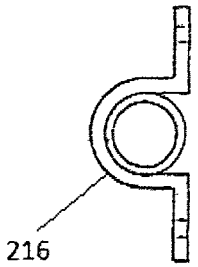
Fig. 6B

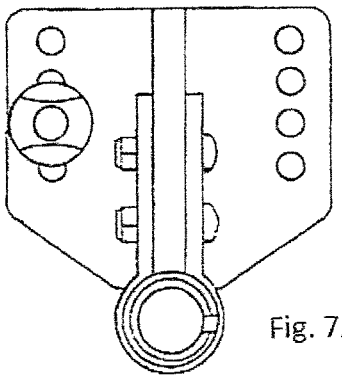
Fig. 7A
Fig. 7C
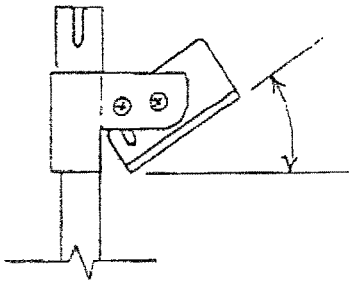
Fig. 7B
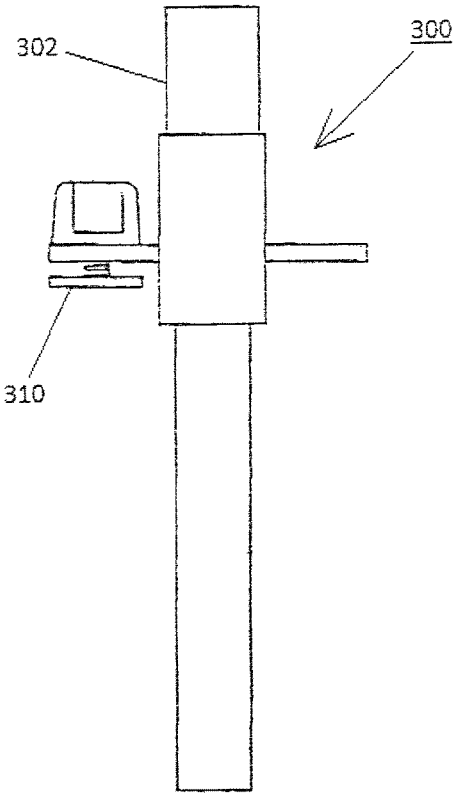
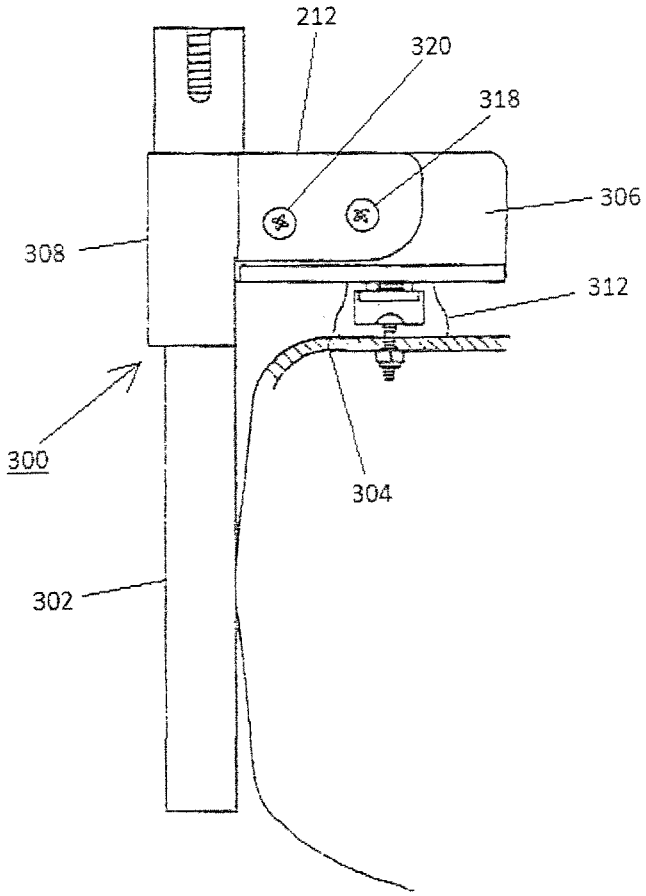
Fig. 7

SHALLOW WATER ANCHOR SYSTEM

RELATED APPLICATION

The present non-provisional application is a continuation-in-part of pending application Ser. No. 13/974,459 filed Aug. 23, 2013, the subject matter of which is incorporate herein by reference.

BACKGROUND OF THE INVENTION

Field of the Invention

The present invention relates to a shallow water anchor system and more particularly pertains to quick deployment, secure anchoring, and cord maintenance, the quick deployment, secure anchoring, and cord maintenance being done in a safe, convenient, and economical manner.

SUMMARY OF THE INVENTION

In view of the foregoing disadvantages inherent in the known types of shallow water anchor systems of known designs and configurations now present in the prior art, the present invention provides an improved shallow water anchor system. As such, the general purpose of the present invention, which will be described subsequently in greater detail, is to provide a new and improved shallow water anchor system and method which has all the advantages of the prior art and none of the disadvantages.

From a broad viewpoint, the present invention is a shallow water anchor system. First provided is a cylindrical receiver with a centrally located washer. The receiver has a lower region and an upper region. The upper region has female screw threads. A cylindrical sleeve is provided. The sleeve has an upper end and a lower end. The upper end of the sleeve has male screw threads threadedly coupled to the female screw threads of the receiver. A cylindrical passageway is formed between the receiver and the sleeve. Also provided is a cylindrical stake. The stake is slidably received in the sleeve. Further provided are a tether line, a movable patch, and a fixed patch. The tether line couples the stake to the movable patch. In this manner, when the movable patch is coupled to the fixed patch, the stake will be in a raised orientation. Also in this manner, when a user separates the movable patch from the fixed patch, the weight of the stake will lower the stake into a lower orientation into a sandy or rocky bottom.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved shallow water anchor system which has all of the advantages of the prior art anchor systems of known designs and configurations and none of the disadvantages.

It is another object of the present invention to provide a new and improved shallow water anchor system which may be easily and efficiently manufactured and marketed.

It is further object of the present invention to provide a new and improved shallow water anchor system which is of durable and reliable constructions.

An even further object of the present invention is to provide a new and improved shallow water anchor system which is susceptible of a low cost of manufacture with regard to both materials and labor, and which accordingly is then susceptible of low prices of sale to the consuming public, thereby making such shallow water anchor system economically available to the buying public.

Lastly, another object of the present invention is to provide a shallow water anchor system for quick deployment, secure anchoring, and cord maintenance. The quick deployment, secure anchoring, and cord maintenance are done in a safe, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a front elevational view of a receiver and coupling components constructed in accordance with a first side mounting alternate embodiment of the invention.

FIG. 5A is a plan view of the first side mounting alternate embodiment of FIG. 5.

FIG. 6 is a front elevational view of a receiver and coupling components constructed in accordance with a second side mounting alternate embodiment of the invention.

FIG. 6A is a plan view of the second side mounting alternate embodiment of FIG. 6.

FIG. 6B is a bottom view of the second side mounting alternate embodiment of FIG. 6.

FIG. 7 is a front elevational view of a receiver and coupling components constructed in accordance with a track mounting alternate embodiment of the invention.

FIG. 7A is a plan view of the track mounting alternate embodiment of FIG. 7.

FIG. 7B is a front elevational view similar to FIG. 7 but with the receiver turned 90 degrees.

FIG. 7C is a front elevational view similar to FIG. 7B but with the pivot clamp rotated with respect to the track base.

The same reference numerals refer to the same parts throughout the various Figures.

DESCRIPTION OF THE PREFERRED EMBODIMENT

Figure 1:
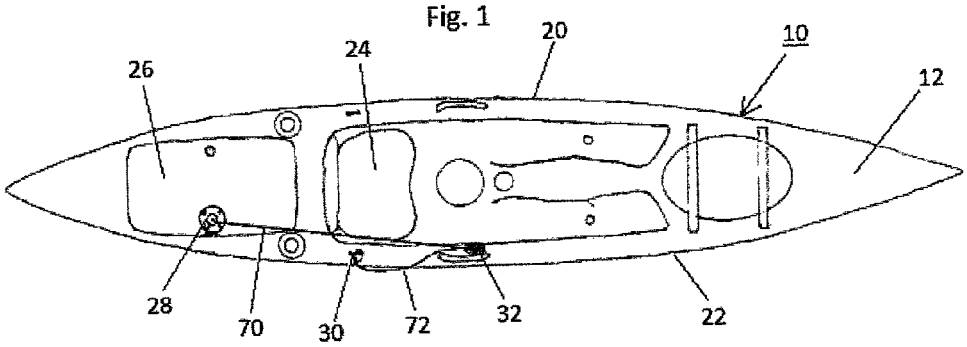
FIG. 1 is a plan view of a shallow water anchor system constructed in accordance with the principles of the present invention, the system being shown on a kayak.
Figure 1A:
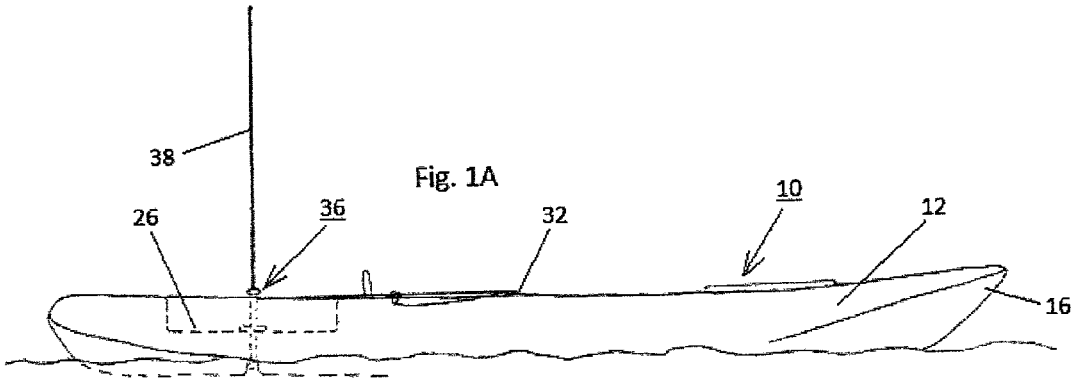
FIG. 1A is a side elevational view of the system illustrated in FIG. 1, the anchor shown in the raised, loaded orientation.
Figure 1B:
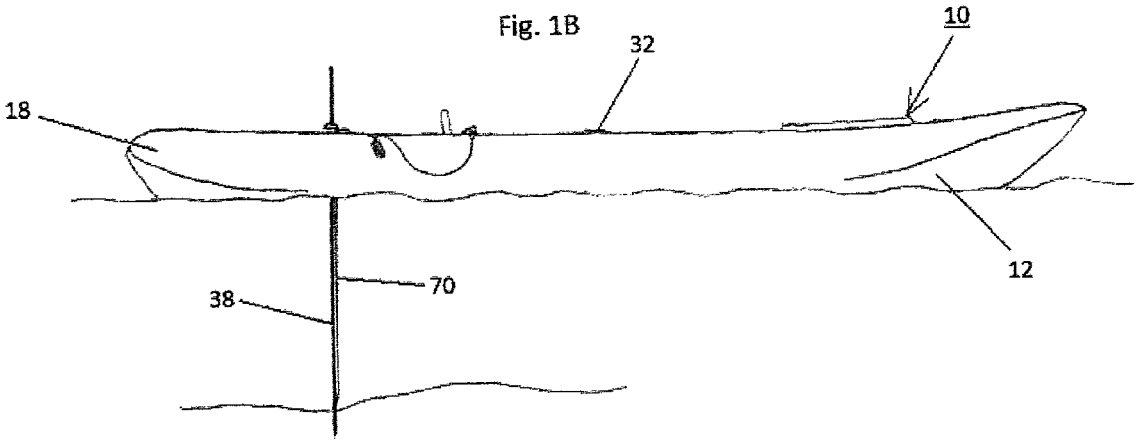
FIG. 1B is a side elevational view of the system illustrated in FIG. 1, the anchor shown in the lowered, operative orientation.
Figure 2:
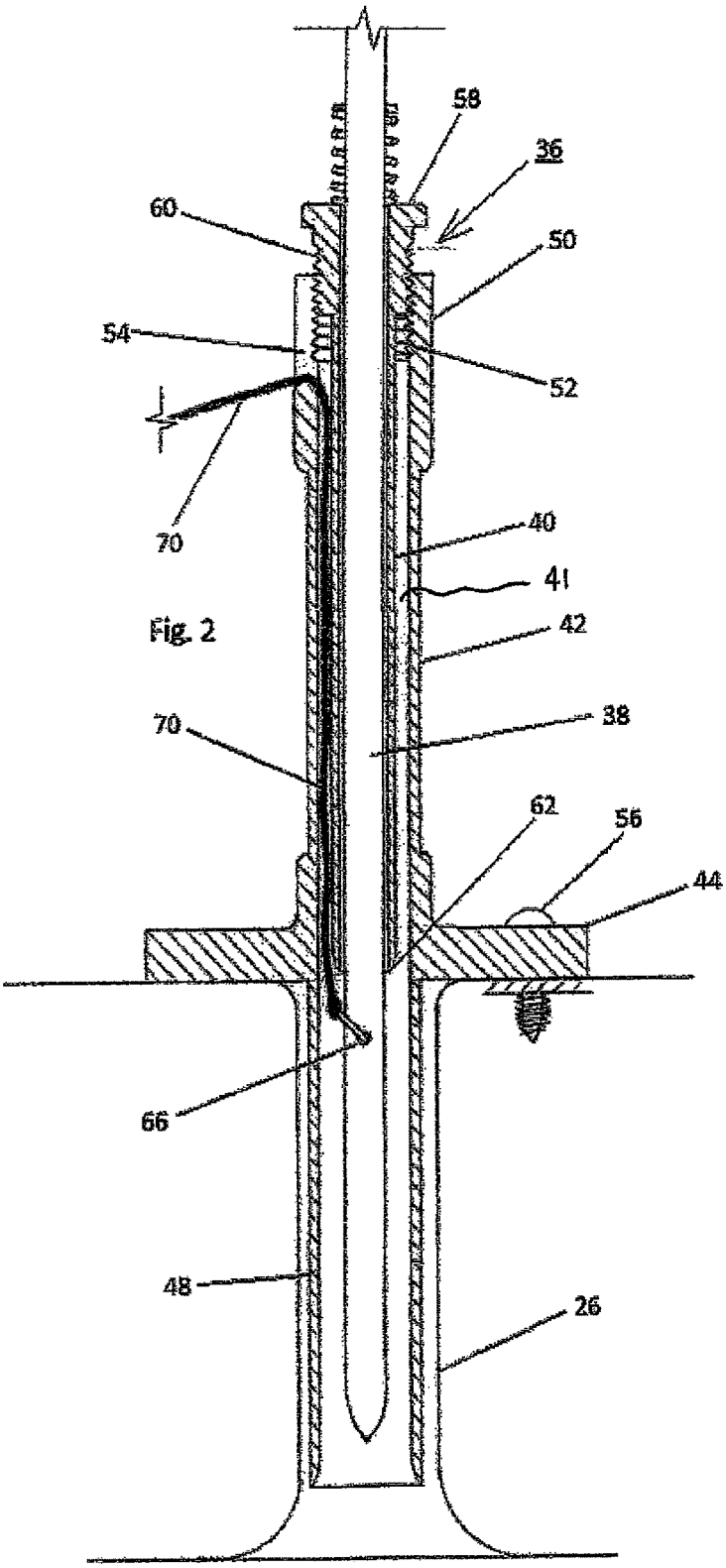
FIG. 2 is an enlarged cross sectional view of the stake/sleeve/receiver assembly shown in the prior Figures.
Figure 2A:
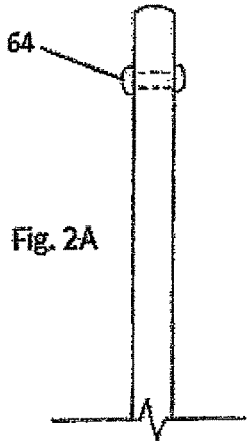
FIG. 2A is a side elevational view of the upper extent of the stake.
Figure 2B:
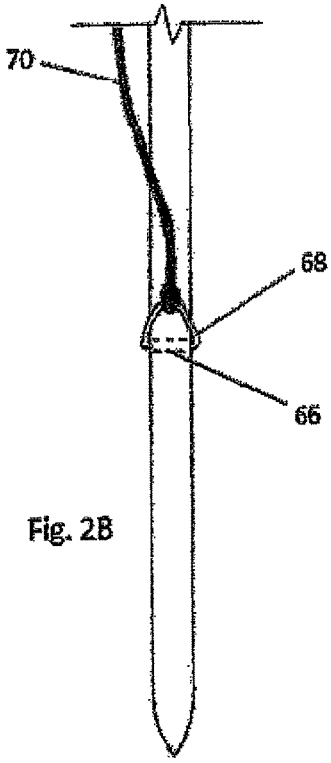
FIG. 2B is a side elevational view of the lower extent of the stake.
Figure 3:
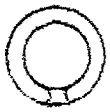
FIG. 3 is cross sectional view of the receiver shown in FIG. 2.
Figure 3A:
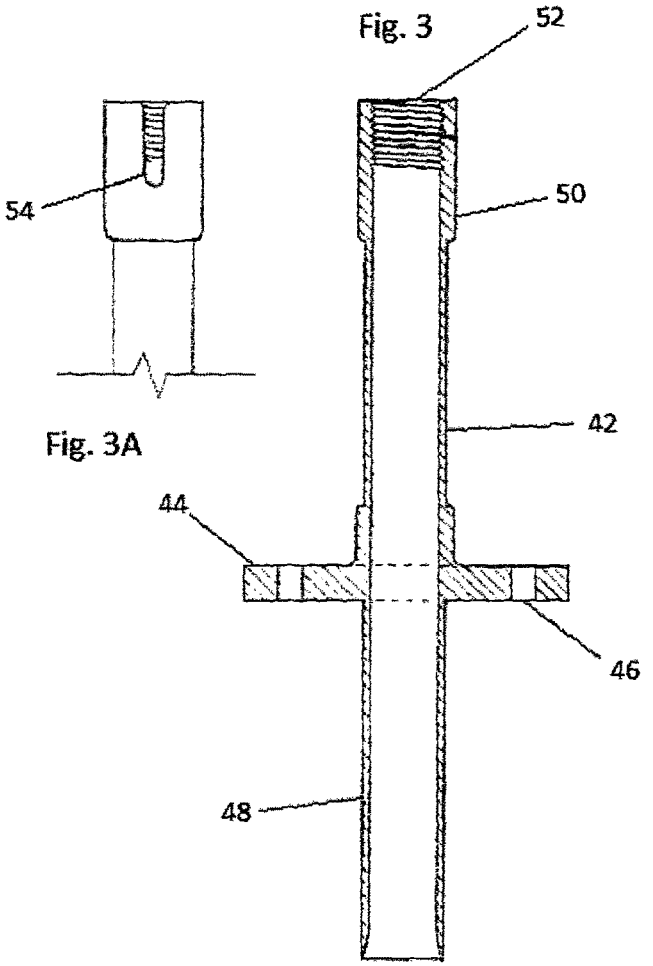
FIG. 3A is a side elevational view of the upper extent of the receiver.
Figure 3C:
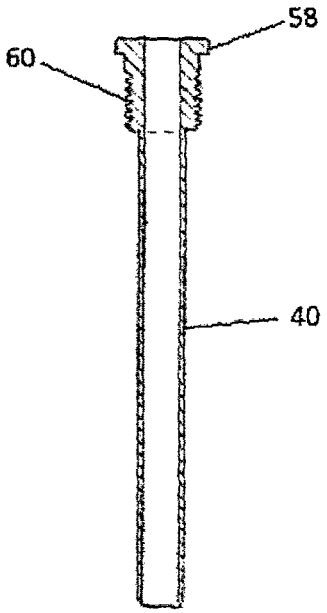
FIG. 3C is cross sectional view of the sleeve shown in FIG. 2.
Figure 3D:
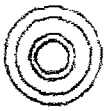
FIG. 3D is a bottom view of the lower extent of the sleeve.
Figure 3B:
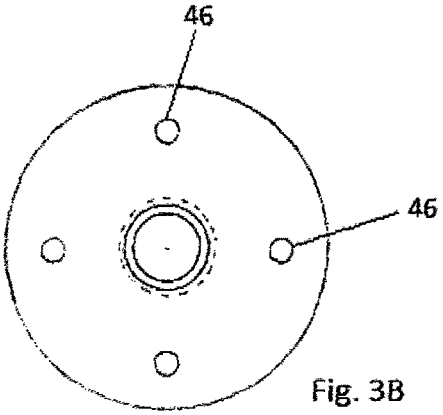
FIG. 3B is a bottom view of the lower extent of the receiver.
Figure 4:
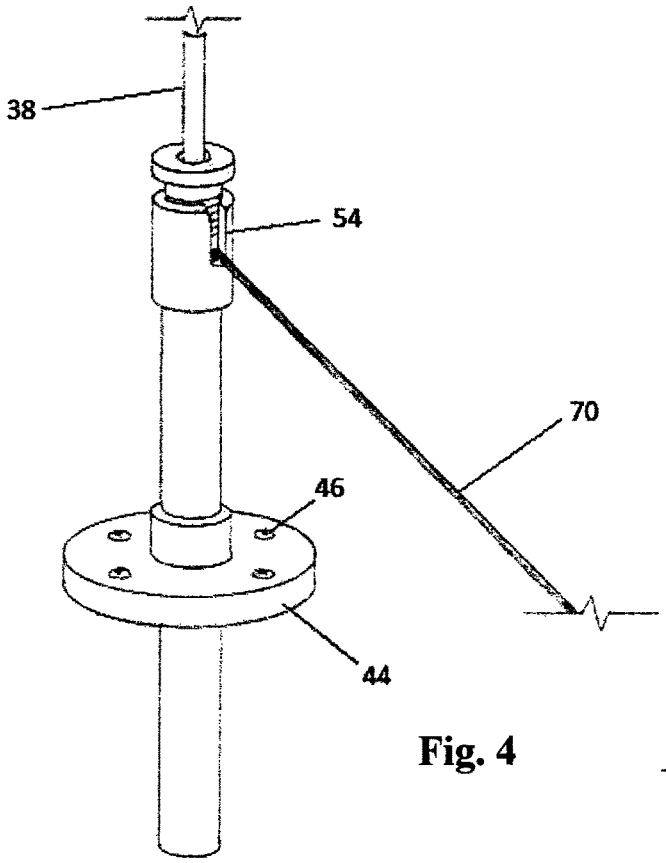
FIG. 4 is a perspective illustration of the tether line and the tag line coupling the stake to the loop patch to the accessory eye.
Figure 4A:
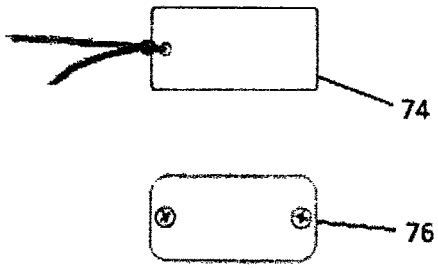
FIG. 4A is an elevational view of the loop and hook patches of FIG. 4.
Figure 4B:
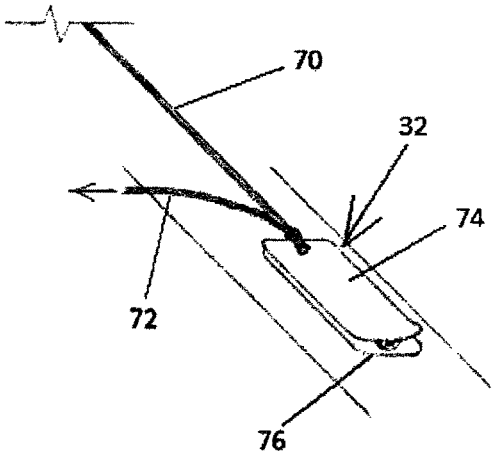
FIG. 4B is a perspective view of the accessory eye shown in FIG. 4.
Figure 4B:
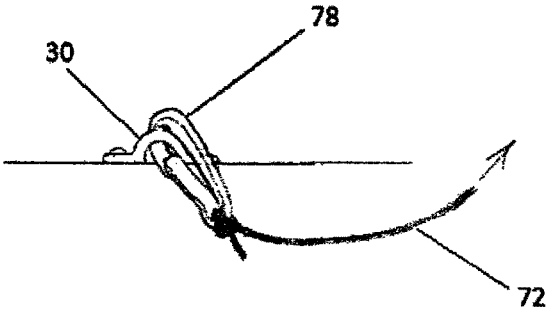

With reference now to the drawings, and in particular to FIG. 1 thereof, the preferred embodiment of the new and improved shallow water anchor system embodying the principles and concepts of the present invention and generally designated by the reference numeral 10 will be described.

The present invention, the shallow water anchor system 10 is comprised of a plurality of components. Such components in their broadest context include a receiver, a sleeve, a stake, and a tether line. Such components are individually configured and correlated with respect to each other so as to attain the desired objective.

From a specific viewpoint, the present invention is a shallow water anchor system. First provided is a kayak 12. The kayak has a forward end 16 and a rearward end 18. The kayak has a left gunwale 20 and a laterally spaced right gunwale 22. A seat 24 is provided located in a central region of the kayak. The kayak has a storage well 26 located between the seat and the rearward end. The kayak has a scupper hole 28 through the kayak at the storage well. The right gunwale has an accessory eye 30 laterally spaced from the seat. The right gunwale has a coupling device 32 forwardly of the accessory eye.

Next provided is an assembly 36. The assembly is formed of a stake 38, a sleeve 40, a receiver 42, and a cylindrical passageway 41.

The receiver 42 is cylindrical in configuration. The receiver has a centrally located washer 44. The receiver has securement apertures 46. The receiver has a lower region 48 extending into the scupper hole. The receiver has an upper region 50 extending above the scupper hole. The upper region has an enlarged upper end with female screw threads 52. The upper end also has a U-shaped slot 54. Threaded fasteners 56 are provided. The threaded fasteners extend through the securement apertures and into the storage well coupling the receiver to the kayak.

The sleeve 40 is cylindrical in configuration. The sleeve has an enlarged upper end 58 with male screw threads 60. The male screw threads are threadedly coupled to the female screw threads of the upper region of the receiver. The sleeve has a lower end 62 terminating in the receiver below at the washer. The cylindrical passageway 41 is formed between the receiver and the sleeve from the U-shaped slot to the washer.

The stake 38 is fabricated of stainless steel. The stake is cylindrical in configuration. The stake is slidably received in the sleeve. The stake has a top with an end stop 64 to precluded into the sleeve. The stake has a bottom with a diametric bore 66. The bottom has a flexible clip 68. The flexible clip is pivotably coupled to the bore. The stake has a length of from 52 inches to 72 inches. The stake has a diameter of 0.3125 inches, plus or minus 10 percent.

A tether line 70 and a tag line 72 are provided. Further provided is a securement device. The securement device includes a two-faced loop patch 74 attached to the tether line and to the tag line. The securement device includes a hook patch 76 secured to the right gunwale. The tether line couples the flexible clip to the loop patch. The tag line couples the loop patch to the accessory eye. The securement device includes a tag clip 78 coupling the tag line to the accessory eye. The tether line is of a length whereby when the loop patch is coupled to the hook patch, the stake will be in a raised, loaded orientation with the bottom of the stake within the sleeve. When a user separates the loop patch from the hook patch, the weight of the stake will lower the stake into a lower operative orientation into a sandy or rocky bottom beneath the kayak.

In an alternate embodiment of the anchor system 100, the receiver 102 with the sleeve and the stake are mounted to the kayak laterally spaced from a side 104 of the kayak. In this embodiment, the system further includes two pivoting clamps 106. Each pivoting clamp has a fixed portion 108. The fixed portions are cylindrical in configuration. The fixed portion is coupled to the receiver at elevationally spaced locations. Each pivoting clamp has a mounting bracket 110. The mounting bracket is attached to the kayak at elevationally spaced locations. Each pivoting clamp has a pivotable portion 112. The pivotable portion couples the fixed portion to the mounting bracket. Also provided is an adjustment bolt 114. The adjustment bolt rotatably adjustably couples the receiver to the kayak.

In another alternate embodiment of the anchor system 200, the receiver 202 with the sleeve and the stake are mounted adjacent to a side 204 of a kayak. In this embodiment, the system further includes one pivoting clamp 206. The pivoting clamp has a fixed portion 208. The fixed portion is cylindrical in configuration. The fixed portion is coupled to the receiver at elevationally spaced locations. The pivoting clamp has a mounting bracket 210 attached to the kayak at elevationally spaced locations. The pivoting clamp has a pivotable portion 212 coupling the fixed portion to the mounting bracket. An adjustment bolt 214 adjustably couples the receiver to the kayak. A fixed clamp 216 is located below the pivoting clamp.

In a final alternate embodiment of the shallow water anchor system 300, the receiver 302 with the sleeve and the stake are adjustably mounted to a kayak 304. The system further includes one pivoting clamp 306. The pivoting clamp has a fixed portion 308. The fixed portion is cylindrical in configuration. The fixed portion is coupled to the receiver. The pivoting clamp has two mounting brackets 310 attachable to the kayak through a track 312. Each pivoting clamp has a pivotable portion 318 coupling the fixed portion to the receiver. Two adjustment bolts 320 adjustably couple the fixed portion to the pivotable portion.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shallow water anchor system (10) for use with a kayak (12), the system adapted for quick deployment, and secure anchoring, and cord maintenance, the quick deployment, secure anchoring, and cord maintenance being done in a safe, convenient, and economical manner, the system comprising, in combination:

the kayak (12) having a forward end (16) and a rearward end (18), a left gunwale (20) and a laterally spaced right gunwale (22), a seat (24) located at a central region of the kayak, a storage well (26) located between the seat and the rearward end, a scupper hole (28) extending through the kayak at the storage well, an accessory eye (30) on the right gunwale laterally spaced from the seat, a coupling device (32) on the right gunwale forwardly of the accessory eye;

an assembly (36) formed of a stake (38) and a sleeve (40) and a receiver (42) and a cylindrical passageway (41);

the receiver formed in a cylindrical configuration having a centrally located washer (44) with securement apertures (46), the receiver having a lower region (48) extending into the scupper hole, the receiver having an upper region (50) extending above the scupper hole, the upper region having an enlarged upper end with female screw threads (52) and a U-shaped slot (54), threaded fasteners (56) extending through the securement apertures and into the storage well coupling the receiver to the kayak;

the sleeve formed in a cylindrical configuration and having an enlarged upper end (58) with male screw threads (60) threadedly coupled to the female screw threads of the upper region of the receiver, the sleeve having a lower end (62) terminating in the receiver below at the washer, the cylindrical passageway (41) formed between the receiver and the sleeve from the U-shaped slot to the washer;

the stake fabricated of stainless steel and formed in a cylindrical configuration, the stake being slidably received in the sleeve, the stake having a top with an end stop (64) to preclude passage into the sleeve, the stake having a bottom with a diametric bore (66) and a flexible clip (68) pivotably coupled to the bore, the stake having a length of from 52 inches to 72 inches and a diameter of 0.3125 inches, plus or minus 10 percent;

a tether line (70) and a tag line (72), a securement device including a two-faced loop patch (74) attached to the tether line and to the tag line, the securement device including a hook patch (76) secured to the right gunwale, the tether line coupled to the flexible clip and extending through the cylindrical passageway and U-shaped slot and secured to the loop patch, the tag line coupling the loop patch to the accessory eye, a tag clip removably coupling the tag line to the accessory eye, the tether line being of a length whereby when the loop patch is coupled to the hook patch, the stake will be in a raised, loaded orientation with the bottom of the stake within the sleeve, and whereby when a user separates the loop patch from the hook patch, the weight of the stake will lower the stake into a lower operative orientation into a sandy or rocky bottom beneath the kayak.

* * * * *